US008082720B2

(12) United States Patent
Mori et al.

(10) Patent No.: US 8,082,720 B2
(45) Date of Patent: Dec. 27, 2011

(54) TABLET PACKING DEVICE

(75) Inventors: Takashi Mori, Ota (JP); Masayoshi Ogura, Tsukuba (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 198 days.

(21) Appl. No.: 12/447,328

(22) PCT Filed: Nov. 13, 2007

(86) PCT No.: PCT/JP2007/071994

§ 371 (c)(1),
(2), (4) Date: Apr. 27, 2009

(87) PCT Pub. No.: WO2008/059826

PCT Pub. Date: May 22, 2008

(65) Prior Publication Data

US 2010/0050570 A1 Mar. 4, 2010

(30) Foreign Application Priority Data

Nov. 16, 2006 (JP) ..... 2006-310832

(51) Int. Cl.
*B65B 35/54* (2006.01)

(52) U.S. Cl. ..... 53/154; 53/237; 53/247; 221/124

(58) Field of Classification Search ..... 53/154, 53/167, 237, 247, 235; 221/124; 700/216, 700/219

See application file for complete search history.

(56) References Cited

U.S. PATENT DOCUMENTS

| | | | | |
|---|---|---|---|---|
| 4,812,629 | A * | 3/1989 | O'Neil et al. | 235/383 |
| 5,875,610 | A * | 3/1999 | Yuyama et al. | 53/75 |
| 6,036,812 | A * | 3/2000 | Williams et al. | 156/277 |
| 6,170,230 | B1 | 1/2001 | Chudy | |
| 7,182,105 | B1 * | 2/2007 | Feehan et al. | 141/2 |
| 2002/0014053 | A1 * | 2/2002 | Kim | 53/154 |

FOREIGN PATENT DOCUMENTS

| | | |
|---|---|---|
| JP | 8-11805 | 1/1996 |
| JP | 2632483 | 4/1997 |
| JP | 2002-514152 A1 | 5/2002 |
| WO | WO 99/29467 A2 | 6/1999 |

OTHER PUBLICATIONS

International Search Report for International Application No. PCT/JP2007/071994 dated Dec. 14, 2007.

* cited by examiner

*Primary Examiner* — Thanh Truong
(74) *Attorney, Agent, or Firm* — Kratz, Quintos & Hanson, LLP

(57) ABSTRACT

In a conventional tablet packing device, a tablet discharged from a tablet case is supplied to a medicine packing unit through a common path such as a hopper. Thus, in the conventional tablet packing device, a large number of types of tablets are collected through the common path, so that a problem of cross contamination (the chipped pieces of the tablet of the type different from that of the tablet to be packed are mixed) occurs. The present invention provides a tablet packing device from which common path is eliminated. The present invention is characterized by including a conveyance unit for conveying a tablet case to a case arrangement section so that a tablet can directly be discharged from the tablet case to a tablet packing unit.

5 Claims, 7 Drawing Sheets

TABLET PACKING DEVICE

BACKGROUND OF THE INVENTION

The present invention relates to a tablet packing device which receives a large number of tablet cases receiving tablets (medicines) and which packs the desired number of the tablets of a desired type in each medicine packing paper sheet and which seals the paper sheet.

In a pharmacy and the like, a tablet packing device packs doses of tablets in medicine packing paper sheets. One example of this tablet packing device is shown in FIG. 1 (see U.S. Pat. No. 6,170,230 B1).

In an upper part 12 of the tablet packing device, a large number of tablet cases 10 are removably received. In each of the tablet cases 10, tablets are received. This tablet case 10 is removed, replenished with the tablets and attached again. This tablet case 10 includes a discharge mechanism capable of discharging the tablets one by one.

The tablets discharged from this tablet case drop down through a vertical common passage 14, and are collected by hoppers 16, 18 in a lower part. Then, the tablets are discharged from the hopper 18 to a packing unit 20, and inserted into a medicine packing paper sheet 22, and then the medicine packing paper sheet 22 containing each dose is sealed.

Another conventional example of the removable tablet case is shown in FIG. 2. FIG. 2 shows a tablet case 30, and a driving source portion on the side of a main body of the tablet packing device to which this tablet case 30 is attached (see Japanese Patent No. 2632483). That is, the tablet case 30 includes a discharge mechanism for discharging one tablet as one unit from the case, but is not provided with a driving source for driving this discharge mechanism. This driving source is provided on the main body side as shown in FIG. 2. When the tablet case 30 is disposed in the main body of the tablet packing device, a gear 32 on this main body side engages with a gear (not shown) on the side of the tablet case. Therefore, the tablet packing device drives a motor 34 corresponding to the tablet case of the tablet of the type to be discharged, to discharge the tablet. This discharged tablet drops down to the vertical common passage through a discharge passage 36.

The dropping of the dropped tablet into the medicine packing paper sheet will be described with reference to FIG. 3 showing another conventional example. As shown in FIG. 3(*a*), the tablet drops down to a hopper 40, is guided along this hopper 40, and drops down into a folded medicine packing paper sheet 42. As shown in FIG. 3(*b*), to allow the tablet to drop down into the folded medicine packing paper sheet 42, both upper ends of this medicine packing paper sheet 42 are opened by guides 44, 46.

After the tablet drops down into the medicine packing paper sheet 42, the sheet containing each dose is sealed by a sealer (not shown).

The outline of this tablet packing device will be described with reference to FIG. 4.

In a tablet packing device 50, a large number of tablet cases 52 are removably received. Each of the tablet cases 52 receives tablets. Moreover, this tablet case 52 includes a discharge mechanism 54 capable of discharging the tablets one by one. When this tablet case 52 is attached to the tablet packing device, the case is connected to a driving source 56.

The discharged tablets drop down through a common space 58, and are collected in a hopper 60 in a lower part. Then, the tablets are discharged from the hopper 60 to a packing unit 62. The packing unit 62 folds a medicine packing paper sheet 66 drawn from a medicine packing paper roll 64, allows the tablets to drop down, and inserts the tablets into the sheet.

Then, after each dose is inserted, the sheet is sealed. A roller section 68 includes a roller to transfer the medicine packing paper sheet 66. Moreover, a seal section 70 also includes a roller to transfer the medicine packing paper sheet 66. Furthermore, this seal section 70 also includes a sealer to seal the medicine packing paper sheet 66.

A control circuit 72 of the tablet packing device drives the driving section 56 corresponding to the desired tablet case 52, to discharge the predetermined tablet. This discharged tablet is supplied to the packing unit 62 through the common space 58 and the hopper 60, and received in the medicine packing paper sheet 66.

This tablet is a coated tablet such as a sugar-coated tablet or a simply formed and uncoated tablet (a bare tablet). In the case of this uncoated tablet, small pieces (the small pieces or medicine powder) peeled from the tablet remain in common paths such as the common space 58 and the hopper 60.

Consequently, in the conventional tablet packing device, a large number of types of tablets are collected through the common path, so that a problem of cross contamination occurs (the contamination generated when chipped pieces of the tablet of the type different from that of the tablet to be packed are mixed in the packing sheet).

In a powdered medicine packing device for packing a powdered medicine (powder, a powder medicine), as disclosed in Japanese Patent Application Laid-Open No. 8-11805, even if a powdered medicine supply path is separately disposed, the powdered medicine can satisfactorily be supplied to the packing unit. This is because the powdered medicine can be transferred even through a thinly formed tube forming the supply path without any trouble. However, the tablet cannot easily be transferred.

Therefore, in the conventional tablet packing device, to suppress the cross contamination, there is disposed a structure in which the supply path can easily be cleaned or a structure in which medicine powder peeled from the tablet does not easily adhere to the supply path, air is blown to the supply path, or air is sucked from the supply path.

SUMMARY OF THE INVENTION

An object of the present invention is to provide a tablet packing device in which a problem of cross contamination is suppressed.

In the present invention, there is provided a tablet packing device characterized by comprising: a plurality of cases each of which receives each of a plurality of types of tablets; and a tablet packing unit which packs the tablet discharged from the case receiving the predetermined tablet, the device further comprising: a receiving section which receives the plurality of cases; a case arrangement section which directly discharges the tablet from the case to the tablet packing unit; and a conveyance unit which conveys the case receiving the predetermined tablet from the receiving section to the case arrangement section.

Furthermore, the present invention is characterized in that the conveyance unit conveys, to the receiving section, the case which is arranged in the case arrangement section and which has completed the discharging of the tablet.

In addition, the present invention is characterized in that the conveyance unit conveys the case which is arranged in the case arrangement section and which has completed the discharging of the tablet to the original position of the case in the receiving section where the case has been received.

Moreover, the present invention is characterized in that the conveyance unit rewrites and changes a memory to store a case receiving position for each tablet type, when conveying the case which is arranged in the case arrangement section and which has completed the discharging of the tablet to a position other than the original position in the receiving section where the case has been received.

Furthermore, the present invention is characterized in that the conveyance unit conveys the case which next discharges the tablet to a case standby section.

According to the present invention, since the tablet is directly supplied from the tablet case to the medicine packing paper sheet, the generation of cross contamination can be suppressed.

DETAILED DESCRIPTION OF THE PREFERRED EMBODIMENT

In the present invention, there is provided a tablet packing device characterized by including a plurality of cases each of which receives each of a plurality of types of tablets, and a tablet packing seal unit which packs the tablet discharged from the case receiving the predetermined tablet, the device further including a receiving section which receives the plurality of cases, a case arrangement section which directly discharges the tablet from the case to the tablet packing unit, and a conveyance unit which conveys the case receiving the predetermined tablet from the receiving section to the case arrangement section.

Embodiment 1

Figure 5:
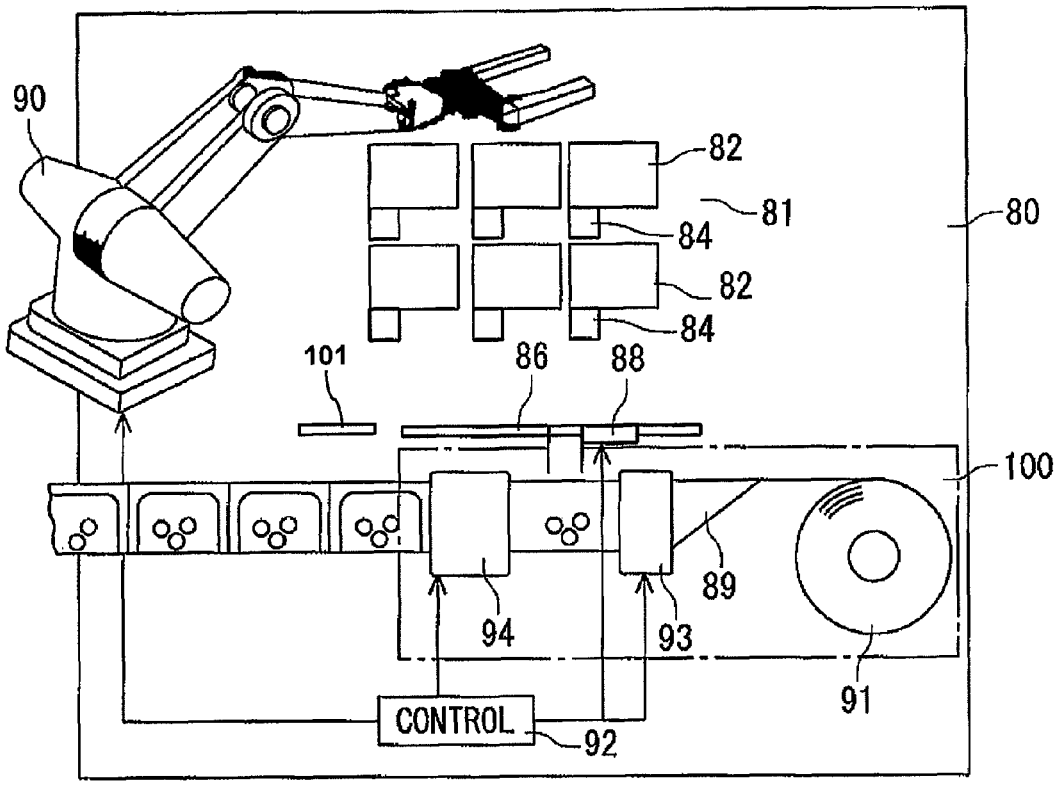
FIG. 5 is a conceptual diagram of Embodiment 1 of a tablet packing device of the present invention.
Figure 6:
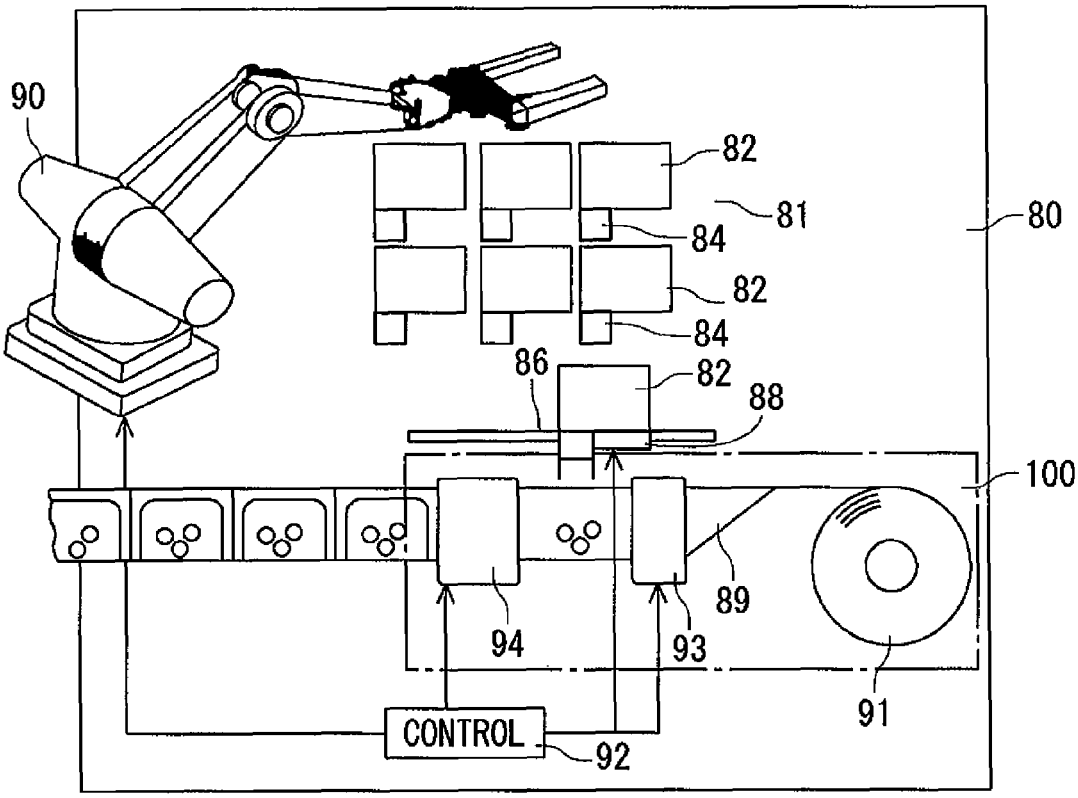
FIG. 6 is a diagram of Embodiment 1 of the present invention.

Embodiment 1 of the present invention will be described with reference to FIGS. 5, 6.

An upper part of a tablet packing device 80 is a receiving section 81, and a large number of tablet cases 82 are removably received in this section. Each of the tablet cases 82 receives tablets. Moreover, the tablet case 82 includes a discharge mechanism 84 capable of discharging the tablets one by one.

A tablet case arrangement base 86 is provided with a driving source 88. A robot arm 90 is controlled by a control circuit 92 to grasp the indicated tablet case 82, transport the case, install the case on the tablet case arrangement base 86 and release the case. At this time, the tablet case 82 is connected to the driving source 88.

The control circuit 92 drives the driving source 88 to discharge the tablet from the tablet case 82, thereby allowing the tablet to drop down into a medicine packing paper sheet 89. It is to be noted that reference numeral 91 is a medicine packing paper roll, 93 is a roller section, and 94 is a seal section.

Needless to say, the tablet is discharged from the tablet case 82 in accordance with the conveyance speed of the medicine packing paper sheet 89, so that one dose is dispensed and packed.

When the packing ends, the robot arm 90 is controlled by the control circuit 92 to grasp the attached tablet case 82, transport the case, return the case to the original position of the case in the receiving section 81 and release the case. Then, the control circuit 92 conveys the next tablet case 82 for use by the robot arm 90.

Thus, according to Embodiment 1, since the tablet can be allowed to directly drop down from the tablet case 82 into the medicine packing paper sheet 89, the generation of cross contamination can be suppressed.

Embodiment 2

Figure 3:
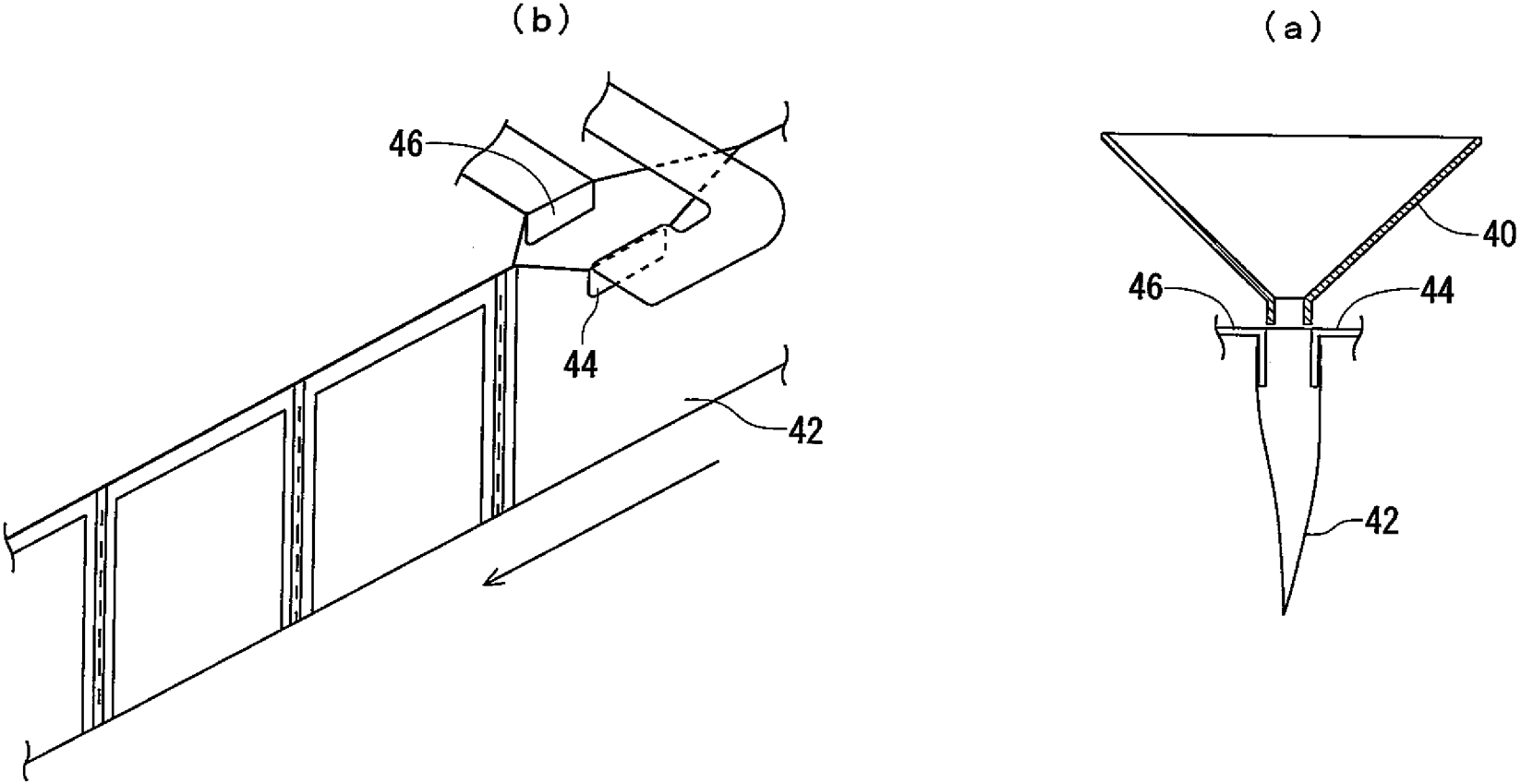
FIG. 3 PRIOR ART
FIG. 3 is a conceptual diagram for explaining the outline of the conventional tablet packing device.
Figure 4:
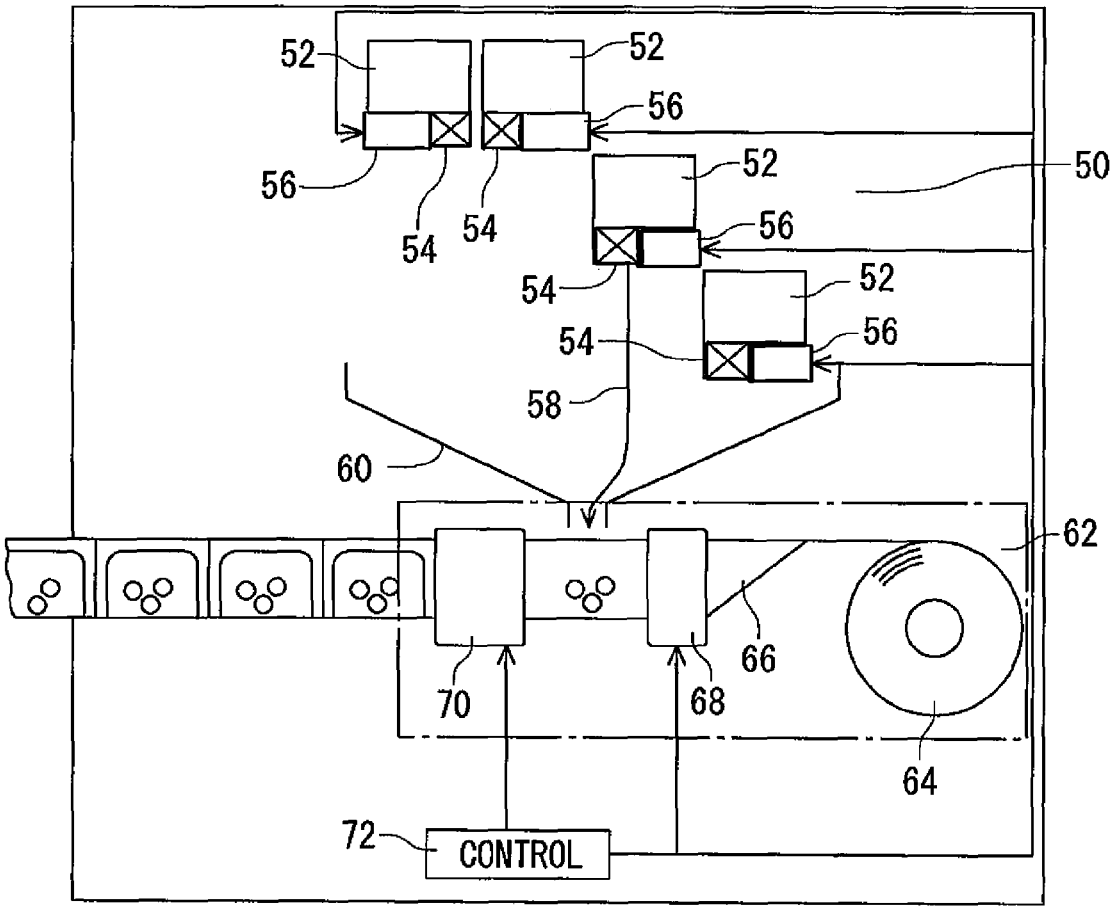
FIG. 4 PRIOR ART
FIG. 4 is a conceptual diagram for explaining the outline of the conventional tablet packing device.

Meanwhile, even in Embodiment 1, there remains a possibility that cross contamination is generated by guides (described with reference to FIG. 3). That is, even in a case where a tablet packing device is realized as in Embodiment 1, when a tablet drops down into a medicine packing paper sheet, small medicine pieces adhere to the guides. When the next type of tablet is packed, the adhering small pieces might drop down into the medicine packing paper sheet.

Figure 7:
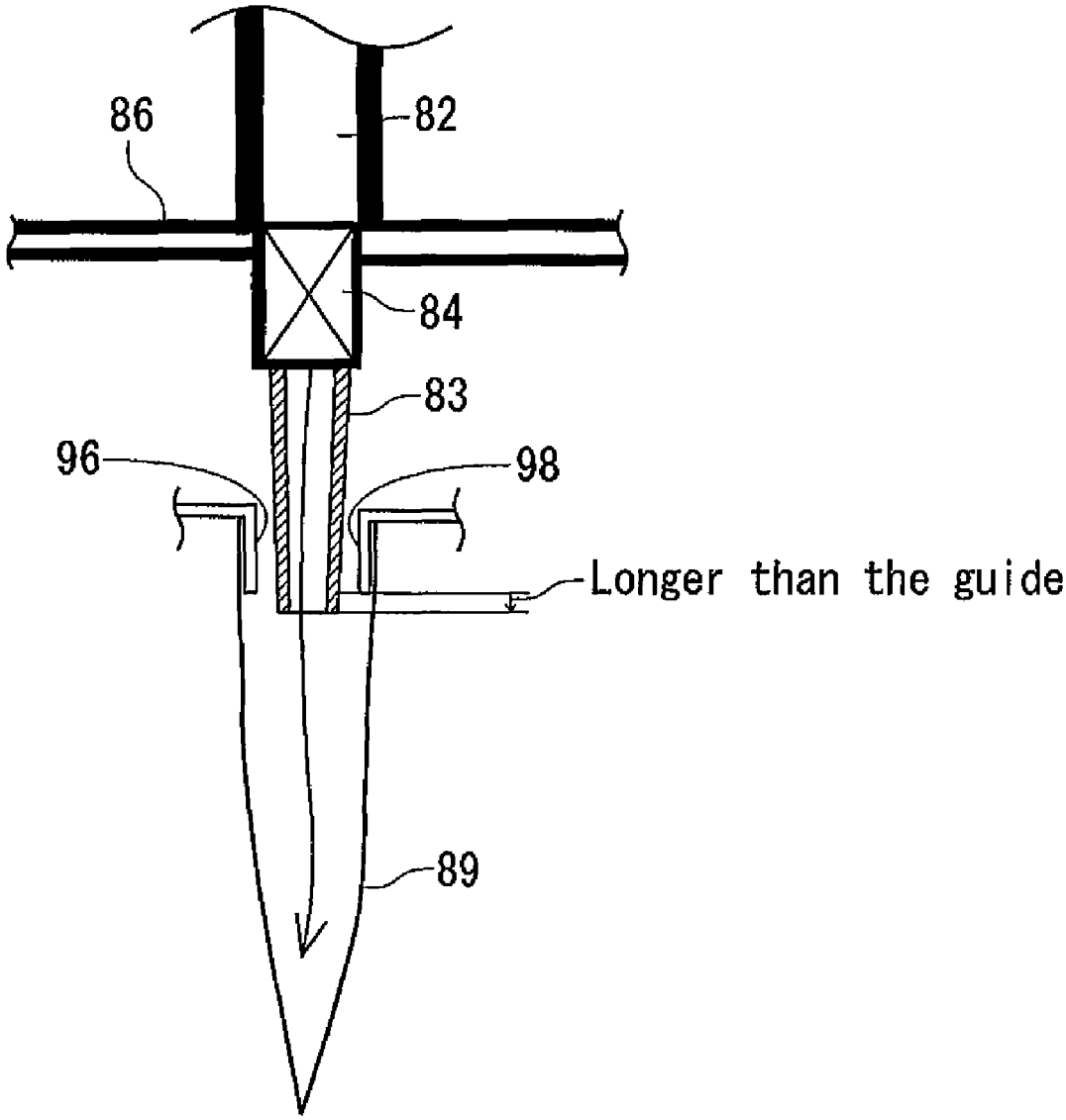
FIG. 7 is a diagram of Embodiment 2 of the present invention.

A countermeasure against this problem is taken in Embodiment 2. The embodiment will be described with reference to FIG. 7.

That is, a dropping tablet guide cylindrical portion 83 is provided under a tablet case 82, and this cylindrical portion 83 is longer than guides 96, 98, whereby the adhering of a powdered medicine (peeled from the tablet) to the guides 96, 98 is suppressed.

The embodiments of the present invention have been described above, but any person skilled in the art can perform various alternatives, modifications or alterations based on the above description, and the various alternatives, modifications or alterations are included in the scope of the present invention.

For example, in the embodiments, the robot arm 90 conveys the tablet case 82, but a conveyance unit is not limited to the embodiments.

Figure 1:
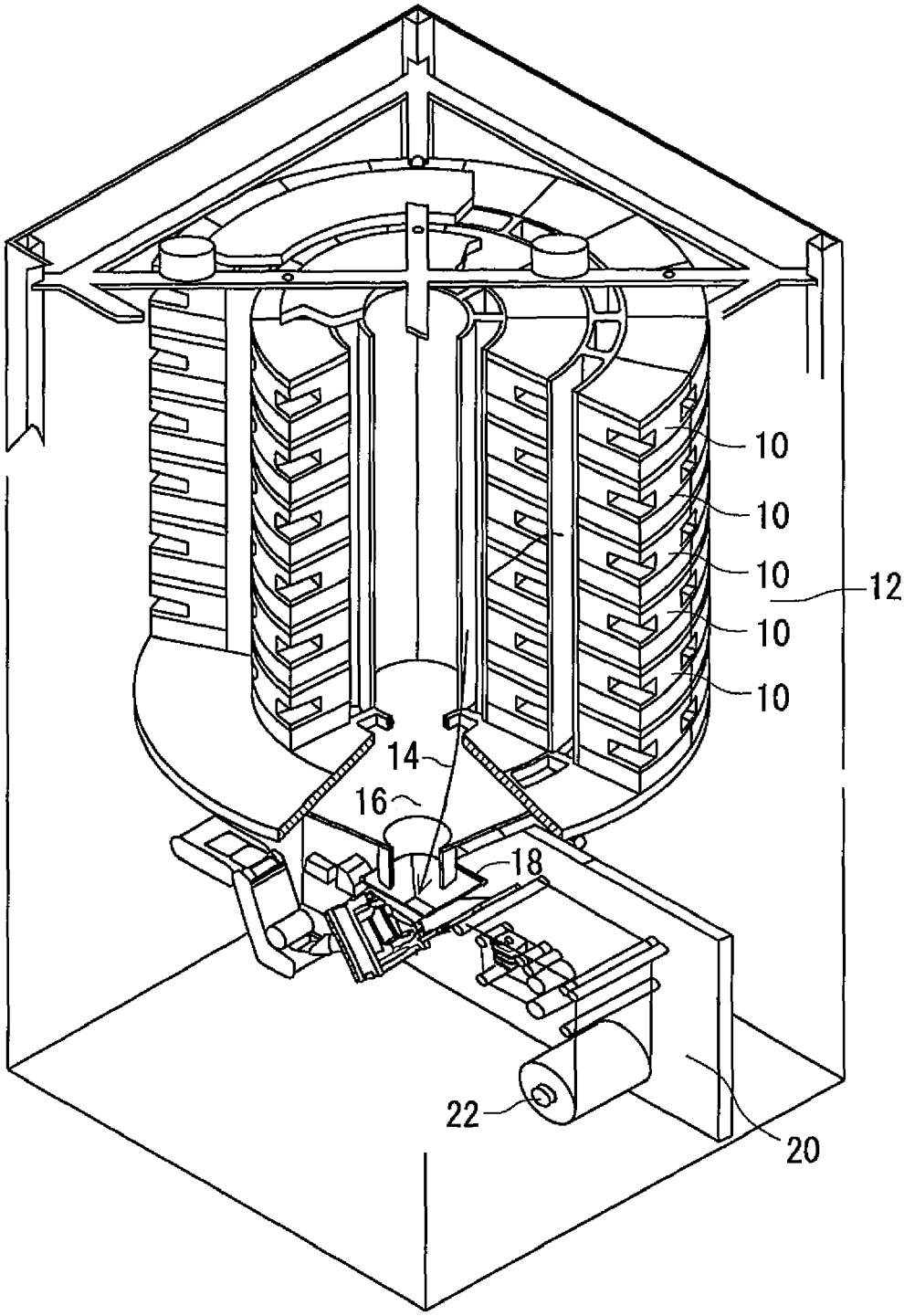
FIG. 1 PRIOR ART
FIG. 1 is a diagram showing one example of a conventional tablet packing device.
Figure 2:
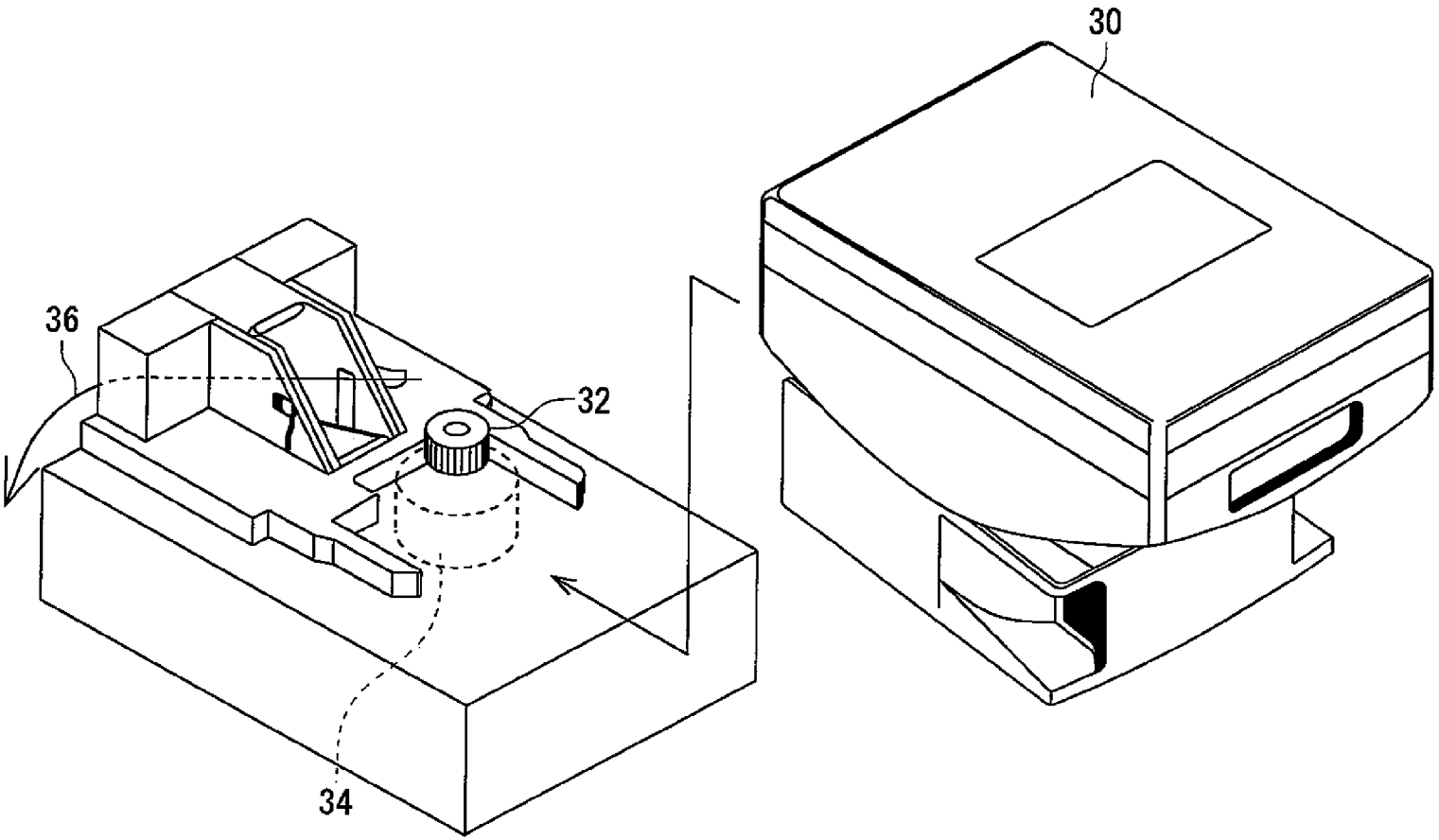
FIG. 2 PRIOR ART
FIG. 2 is a perspective view showing another conventional tablet case and a driving source for the tablet case.

Moreover, when the conveyance by the conveyance unit is taken into consideration, as in FIG. 1 showing a conventional technology, a plurality of tablet cases are cylindrically received and arranged, a user detachably attaches the tablet case from the outside of the device, and the conveyance unit may be disposed in the center of this cylindrical arrangement to discharge or return the tablet case in the device.

Furthermore, the conveyance unit returns the tablet case 82 installed on the tablet case arrangement base 86 to the original position, but may return the case to another vacant position if any. However, in this case, the receiving position of the tablet case changes, whereby the user might be confused. Therefore, in this case, it is necessary to take such a countermeasure that the user is not confused with even the changed receiving position of the tablet case.

In addition, to shorten the conveyance time of the tablet case by the conveyance unit, a case standby section for disposing the next tablet case for use may be provided near the tablet case arrangement base 86. The conveyance unit may temporarily dispose the tablet case which has completed the discharging or the next tablet case for use in this case standby section 101, to shorten a time required for changing the tablet case 82 arranged on the tablet case arrangement base 86.

It is to be noted that when the same type of tablets are dispensed and packed in the medicine packing paper sheets, processing can be performed quickly. However, when a plurality of types of tablets are packed, the tablet cases can alternately be exchanged every two packages to discharge the tablets thereinto.

What is claimed is:

1. A tablet packing device comprising:

a plurality of cases each of which receives each of a plurality of types of tablets; and a tablet packing unit which packs the tablet discharged from the case receiving the predetermined tablet, the device further comprising:

a receiving section which receives the plurality of cases;

a case arrangement section which directly discharges the tablet from the case to a medicine packing paper sheet of the tablet packing unit; and a conveyance unit which conveys the case from the receiving section to the case arrangement section.

2. The tablet packing device according to claim 1, wherein the conveyance unit returns, to the receiving section, the case which is arranged in the case arrangement section and which has completed the discharging of the tablet.

3. The tablet packing device according to claim 1, wherein the conveyance unit returns the case which is arranged in the case arrangement section and which has completed the discharging of the tablet to the original position of the case in the receiving section where the case has been received.

4. The tablet packing device according to claim 3, wherein the conveyance unit rewrites and changes a memory to store a case receiving position for each tablet type, when conveying the case which is arranged in the case arrangement section and which has completed the discharging of the tablet to a position other than the original position in the receiving section where the case has been received.

5. The tablet packing device according to any one of claims 1 to 4, wherein the conveyance unit conveys the case which next discharges the tablet to a case standby section.

* * * * *